US006837278B2

(12) United States Patent
Kim et al.

(10) Patent No.: US 6,837,278 B2
(45) **Date of Patent: *Jan. 4, 2005**

(54) METHOD FOR MAKING A BLANKET HAVING A HIGH PILE DENSITY AND A BLANKET MADE THEREFROM

(76) Inventors: William B. Kim, 3200 Union Pacific Ave., Los Angeles, CA (US) 90023; Charles S. Kim, 6060 Oak St., Unit W, Huntington Park, CA (US) 90255

( * ) Notice: Subject to any disclaimer, the term of this patent is extended or adjusted under 35 U.S.C. 154(b) by 103 days.

This patent is subject to a terminal disclaimer.

(21) Appl. No.: 10/138,121

(22) Filed: May 3, 2002

(65) Prior Publication Data

US 2003/0172985 A1 Sep. 18, 2003

Related U.S. Application Data

(63) Continuation-in-part of application No. 10/095,761, filed on Mar. 13, 2002, now Pat. No. 6,647,601.

(51) Int. Cl.[7] ..... D03D 27/00

(52) U.S. Cl. ..... 139/391; 139/399; 139/407; 156/72; 28/159; 28/143

(58) Field of Search ..... 139/2, 391, 392, 139/396, 399, 407, 403, 402, 401, 397, 394; 28/159, 143; 156/72

(56) References Cited

U.S. PATENT DOCUMENTS

| | | | | |
|---|---|---|---|---|
| 2,238,098 A | | 4/1941 | Bradshaw | |
| 2,247,308 A | * | 6/1941 | Redman | 428/93 |
| 2,327,278 A | | 8/1943 | Lurie | |
| 2,908,013 A | | 10/1959 | Keen et al. | |
| 3,024,518 A | | 3/1962 | Newton | |
| 3,383,259 A | | 5/1968 | Cochran, II | |
| 3,847,719 A | | 11/1974 | Crowley | |
| 4,439,476 A | | 3/1984 | Guold | |
| 4,668,552 A | | 5/1987 | Scott | |
| 4,668,553 A | | 5/1987 | Scott et al. | |
| 5,431,324 A | * | 7/1995 | Kajiwara et al. | 228/102 |
| 5,598,615 A | | 2/1997 | Takada | |
| 5,994,686 A | * | 11/1999 | Salina | 219/745 |
| 6,463,963 B1 | * | 10/2002 | Moody et al. | 139/420 R |
| 6,647,601 B2 | * | 11/2003 | Kim | 28/159 |

OTHER PUBLICATIONS

23 Commercial Invoices for Unidos Manufacturing.
28 Commercial Invoices for C and W International.
A Commercial invoice for Colossus Imp.E. Exp. LTDA.
A Commercial Invoice for Jr Wholesale Enterprises LTD.

* cited by examiner

*Primary Examiner*—Gary L. Welch
*Assistant Examiner*—Robert H. Muromoto, Jr.
(74) *Attorney, Agent, or Firm*—Park & Sutton LLP; John K. Park

(57) ABSTRACT

A method for making a fabric having a ground and pile threads inserted between the ground threads is provided. The method comprises a step of weaving two fabrics simultaneously so that the fabrics are positioned parallel and spaced by a predetermined distance, and the pile threads are inserted alternately between the ground threads of one fabric and between those of the other fabric. Also, each pile thread is wound around one of the ground threads by one or more turns. The method further comprises cutting the pile threads between the fabrics, and heat setting the fabrics to bind the pile threads to the ground firmly. The pile threads are made of acrylic yarn, and the weight percentage of the pile threads in the fabric is between 80 and ninety-five 95, and the weight percentage of the ground threads in the fabric is the remainder.

16 Claims, 6 Drawing Sheets

METHOD FOR MAKING A BLANKET HAVING A HIGH PILE DENSITY AND A BLANKET MADE THEREFROM

RELATED APPLICATION

This application is a continuation-in-part of U.S. patent application Ser. No. 10/095,761, filed Mar. 13, 2002 now U.S. Pat. No. 6,647,601.

BACKGROUND OF THE INVENTION

The present invention relates to a method for making a blanket. More particularly, the invention relates to a method for making a blanket having a high pile density.

A fabric for a blanket is made by weaving a ground with a low-grade yarn such as a polyester yarn or a cotton yarn, and inserting pile threads in the spaces between the wefts and warps of the ground. A high-grade yarn such as an acrylic yarn is used as pile threads. Increasing the ratio of pile threads against ground threads, that is inserting pile threads denser, enhances the quality of the blanket, such as the feel or the appearance of the blanket. However, there has been a limit to increase the ratio due to the problem of inserting piles densely in the narrow spaces between the wefts and warps of the ground, and preventing the densely inserted piles from falling out when the blanket is in use. Also, it has been difficult to make the pile threads have uniform length, uniform density, and fine cut ends, thereby improving the appearance and feel of the pile threads.

Accordingly, there has been a demand for an improved method for increasing the ratio of piles in the finished blanket-like products, and for improving the appearance and feel of the pile threads.

SUMMARY OF THE INVENTION

The present invention is contrived to overcome the conventional disadvantages. Therefore, an object of the invention is to provide a method for making a blanket with denser pile threads.

Another object of the invention is to provide a blanket having a high-grade feel and appearance.

Still another object of the invention is to provide a durable blanket with denser pile threads.

Still another object of the invention is to provide a blanket with pile threads having uniform length, density and smooth ends.

To achieve the above-described objects, the invention provides a method for making a fabric, which has a ground having a plurality of ground threads, and a plurality of pile threads inserted between the ground threads. The method comprises the steps of weaving a two fabrics simultaneously, cutting the pile threads between the two fabrics, and heat setting the fabrics to bind the pile threads to the ground firmly. In the weaving step, the two fabrics are positioned parallel with each other and spaced from each other by a predetermined distance. The pile threads are inserted alternately between the ground threads of one fabric and between the ground threads of the other fabric. Each of the pile threads is wound around one of the ground threads by one or more turns.

The pile threads are made of acrylic yarn, and the weight percentage of the pile threads in the fabric is in the range between approximately eighty (80) and ninety-five (95), and the weight percentage of the ground threads in the fabric is the remainder. The ground threads are made of polyester, cotton, or a blend of polyester and cotton.

More specifically, the weaving step of the method comprises the steps of inserting free ends of the plurality of the pile threads between the ground threads of one fabric, winding the pile threads around one of the ground threads of the one fabric by one or more turns, inserting the free ends of the pile threads between the ground threads of the other fabric, winding the pile threads around one of the ground threads of the second fabric by one or more turns, and repeating these steps until the two fabrics are weaved to a predetermined size.

The heat setting step of the method comprises heating the fabric such that the ground threads and the pile threads contract in length and expand in diameter. he heating is done by immersing the fabric in hot water and then drying the fabric. Also, the heating may be done with ultrasonic wave or microwave.

Alternatively, the heat setting step of the method comprises heating the fabric such that the ground threads and the pile threads weld together. The heating is done with ultrasonic wave or microwave. Heat is concentrated where the pile threads are bound to the ground threads.

The method of making the fabric may further comprise a step of coloring the fabric with a predetermined pattern between the cutting step and the heat setting step.

The invention also provides a fabric made according to the method.

For making a blanket from a fabric made according to the method, the fabric is cut to a predetermined size for the blanket, and the edges of the cut fabric are surrounded with a cloth.

The advantages of the present invention are numerous in that: (1) a blanket having a high-grade feel and appearance can be provided; (2) pile threads of the blanket do not fall out of the ground even after prolonged use; (3) an efficient method of increasing pile density in a blanket is provided; and (4) an improved method of finishing pile threads is provided.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
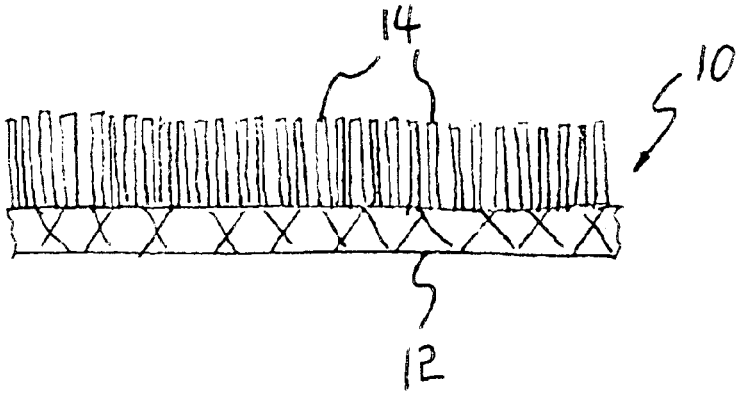
FIG. 1 is a schematic illustrative view showing a fabric having a ground and pile threads bound to the ground on one side of the ground.

FIG. 1 shows a fabric 10 for making a blanket. The fabric 10 has a ground 12 and a plurality of pile threads 14 bound to the ground 12. The pile threads 14 are bound to the ground 12 on one side of the ground 12. The pile threads 14 protrude from the ground 12 and are spaced very densely. As the density of the pile threads 14 increases, the quality such as feel and appearance of the fabric and hence the quality of the blanket made of the fabric improves. As a pile thread, a high-grade yarn, such as an acrylic yarn is used for its superior feel, appearance and thermal insulation. As yarns for warps and wefts of the ground, low-grade yarns such as polyester, cotton, and a blend of them, etc. are used. The quality of a blanket may be checked by comparing the percentage of the piles. If the weight percentage of piles is below 70%, the quality of the blanket is so poor. As the percentage increases, the feel of the blanket becomes smooth and silky. The present invention provides a method for making a fabric for blanket that has a weight percentage of the acrylic yarn, that is, the weight percentage of the pile threads in the fabric is in the range between approximately eighty (80) and ninety-five (95), and the weight percentage of the ground threads in the fabric is the remainder.

Figure 2:
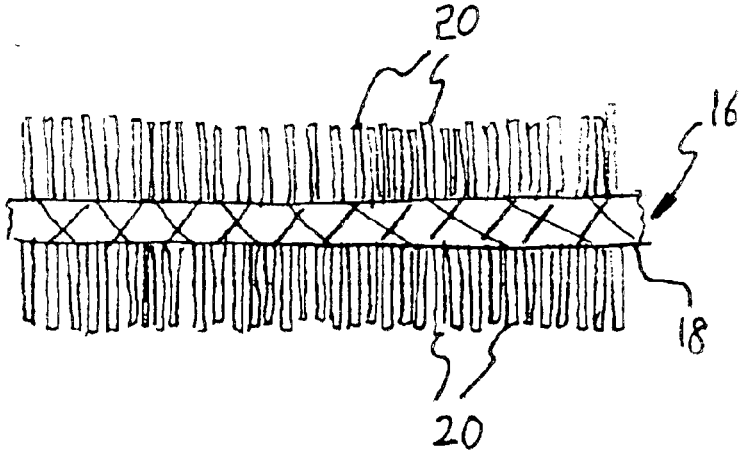
FIG. 2 is a view similar to FIG. 1 wherein the pile threads are bound to on both sides of the ground.

FIG. 2 shows another fabric 16 for making a blanket. The fabric 16 has a ground 18 and a plurality of pile threads 20 bound to the ground 18 on both sides of the ground 18.

Figure 3:
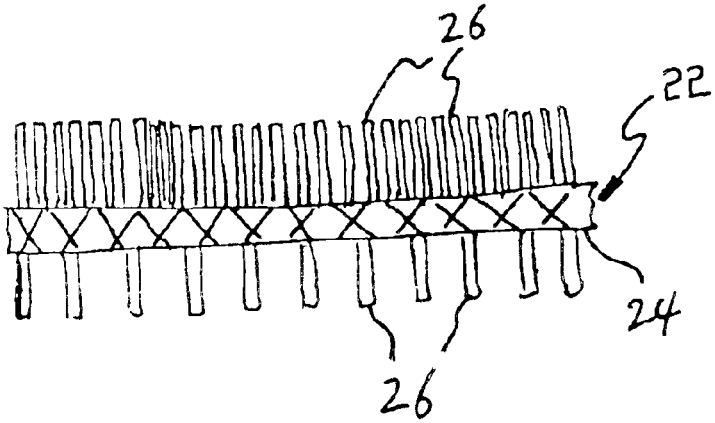
FIG. 3 is a view similar to FIG. 1 wherein dense pile threads are bound on one side of the ground and short, sparse pile threads are bound on the other side of the ground.

FIG. 3 shows another fabric 22 for making a blanket. The fabric 22 has a ground 24 and a plurality of piles 26 bound to the ground 24 on one side of the ground 24. There are some portions of piles that are wound around the wefts and warps of the ground 24 on the other side of the ground 24. After binding the pile threads 26 to the ground 24, the other side of the ground 24 is scratched so that the portions of the pile threads 26 are cut and protrude from the ground 24. The pile threads 26 on the other side of the ground 24 are shorter and less dense.

Figure 14:
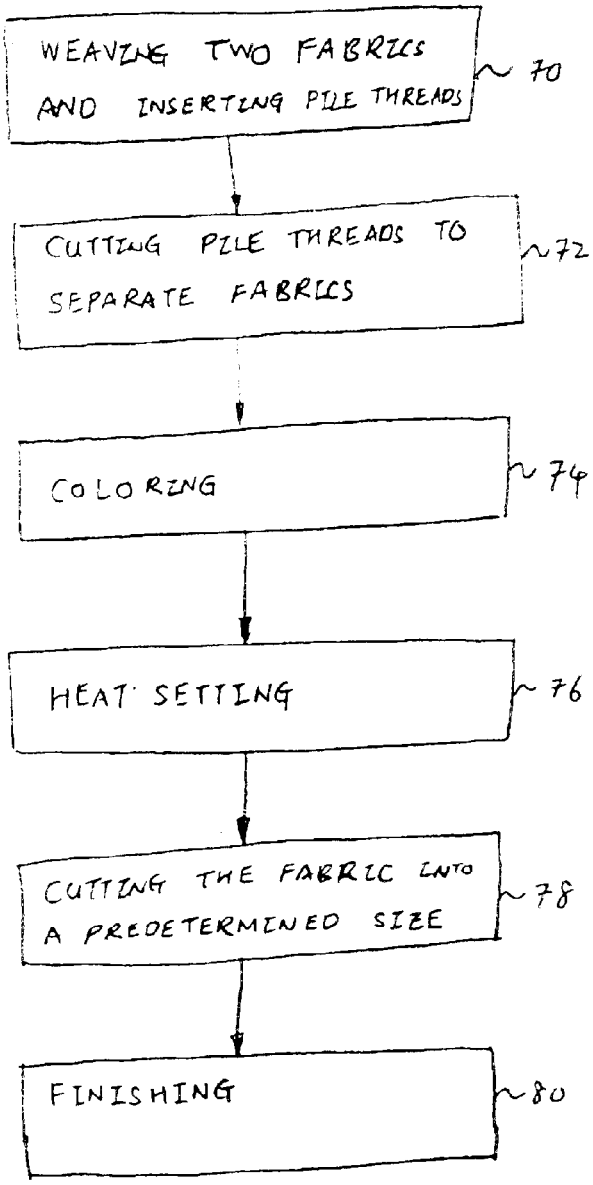
FIG. 14 is a flow diagram showing a method of making a blanket according to the invention.

FIG. 14 shows a flow diagram for the method of making the fabric. The first step 70 of the method of the present invention is weaving two fabrics and inserting pile threads. Two fabrics are positioned parallel with each other, and spaced from each other by a predetermined distance. A plurality of ground threads are weaved to make grounds for the fabrics. Weaving the grounds of the fabrics and inserting pile threads between the ground threads are performed simultaneously. The pile threads are inserted alternately between the ground threads of one fabric and between the ground threads of the other fabric. Each of the pile threads is wound around one of the ground threads by one or more turns.

Figure 4:
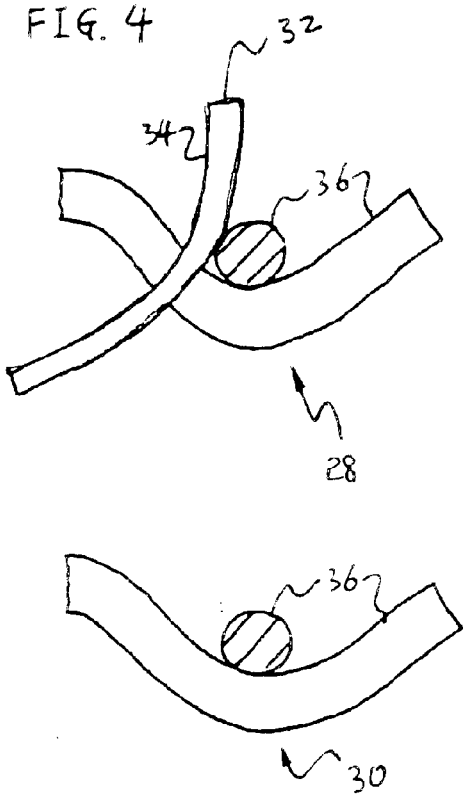
FIG. 4 is a schematic view showing that the end of a pile thread is inserted between the ground threads of one of two fabrics being weaved simultaneously.
Figure 5:
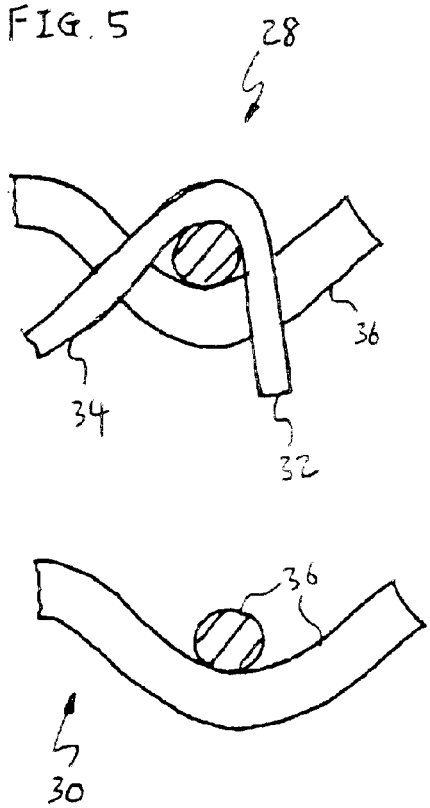
FIG. 5 is a schematic view showing that the pile thread is bent around a ground thread.
Figure 6:
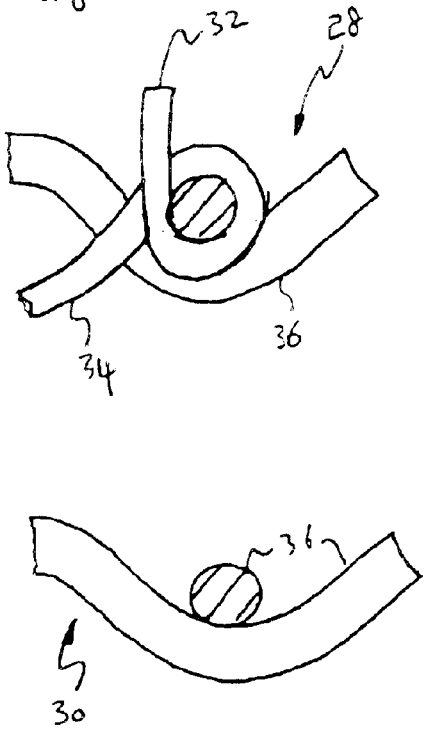
FIG. 6 is a schematic view showing that the pile thread is wound around the ground thread.
Figure 7:
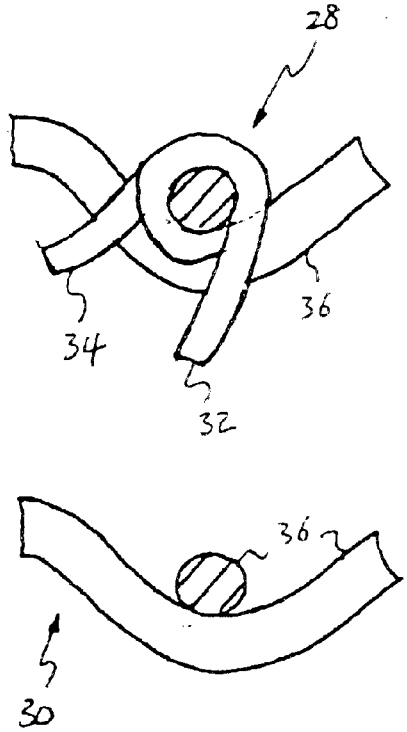
FIG. 7 is a schematic view showing that the end of the pile thread is guided toward the other fabric.
Figure 8:
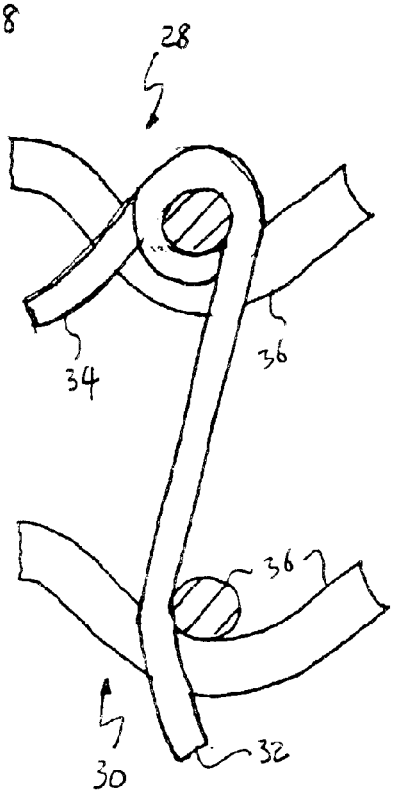
FIG. 8 is a schematic view showing that the end of the pile thread is inserted between the ground threads of the other fabric.
Figure 9:
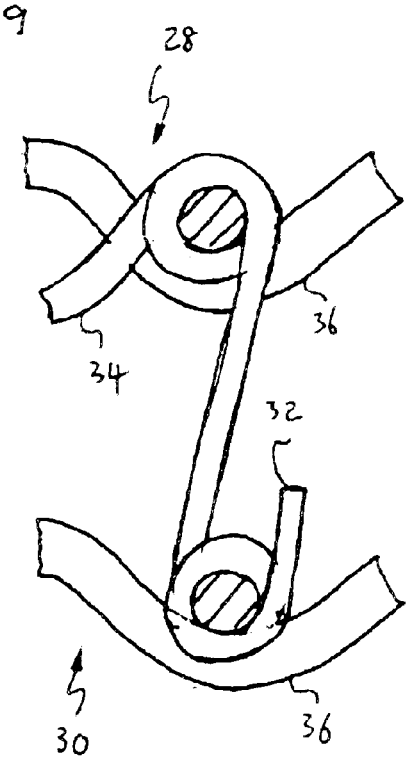
FIG. 9 is a schematic view showing that the pile thread is wound around a ground thread of the other fabric.
Figure 10:
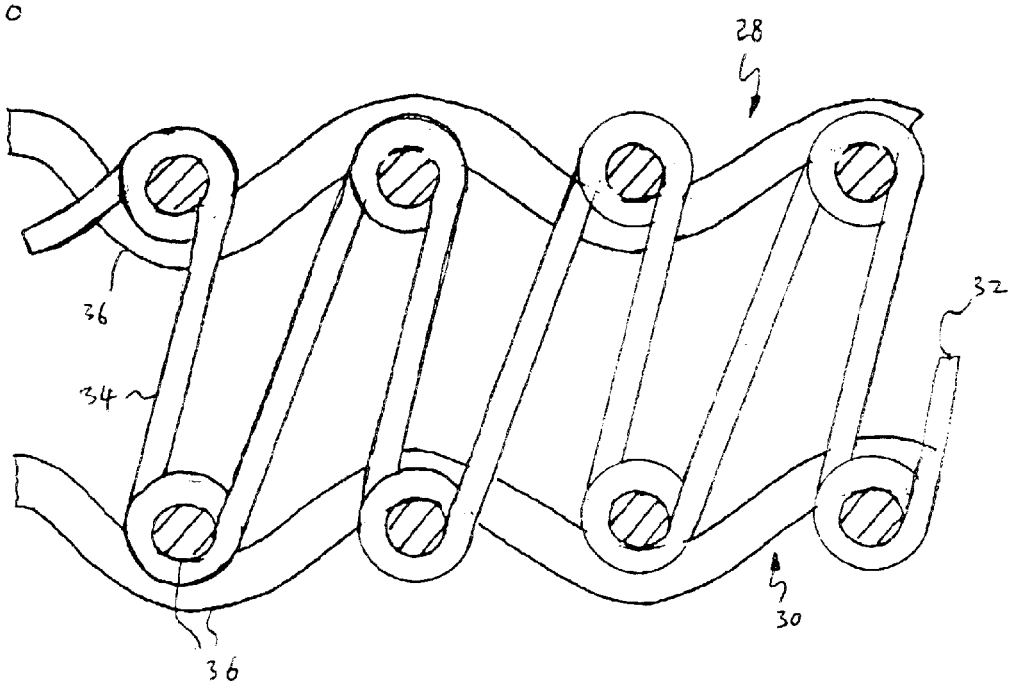
FIG. 10 is a schematic view showing that a pile thread is alternated between the two fabrics, and wound around the ground threads of the fabrics.

FIGS. 4–11 illustrate the weaving step in detail. As shown in FIG. 4, a first fabric 28 and a second fabric 30 are weaved simultaneously. The first fabric 28 and the second fabric 30 are positioned parallel with each other, and spaced from each other by a predetermined distance. A free end 32 of a pile thread 34 is inserted between ground threads 36 of a first fabric 28. FIG. 5 shows that the pile thread 30 is bent around one of the ground threads 36. FIG. 6 shows that the pile thread 34 is wound around the ground thread 36 by one turn. FIG. 7 shows that the end 32 of the pile thread 34 is guided toward the second fabric 30. FIG. 8 shows that the end 32 of the pile thread 34 is inserted between the ground threads 36 of the second fabric 30. FIG. 9 shows that the pile thread 34 is wound around the ground thread 36 of the second fabric 30 by one turn. FIG. 10 shows that the fabrics 28, 30 continue to be weaved, and the pile thread 34 is alternated between the first fabric 28 and the second fabric 30, and wound around the ground threads 36 of the first fabric 28 and second fabric 30.

Figure 11:
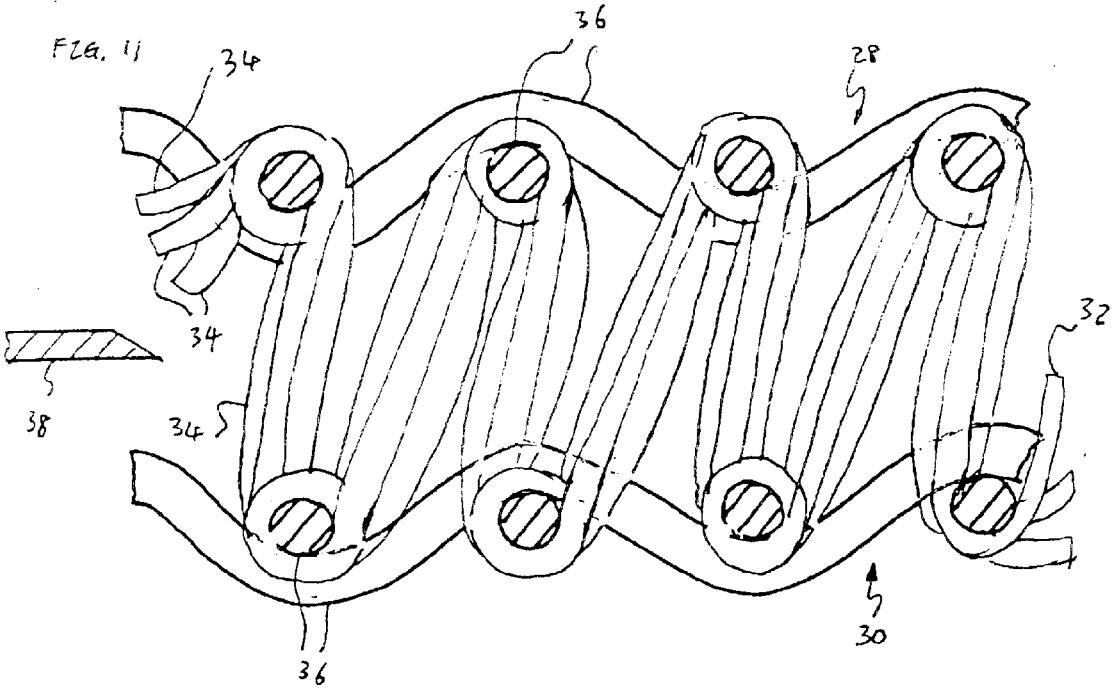
FIG. 11 is a schematic view showing that a plurality of pile threads are alternated between the two fabrics, and wound around the ground threads of the fabrics.

Although FIGS. 4–10 shows one pile thread 34 for illustrative purpose, a plurality of pile threads 34 may be wound around the ground thread 36 at the same time. FIG. 11 shows that a plurality of pile threads 34 are alternated between the two fabrics 28, 30, and wound around the ground threads 36 of the fabrics 28, 30. The number of the pile threads is controlled so that the weight percentage of the pile threads in the fabric, that is, acrylic yarn percentage in the fabric is in the range between 80 and 95.

Figure 15:
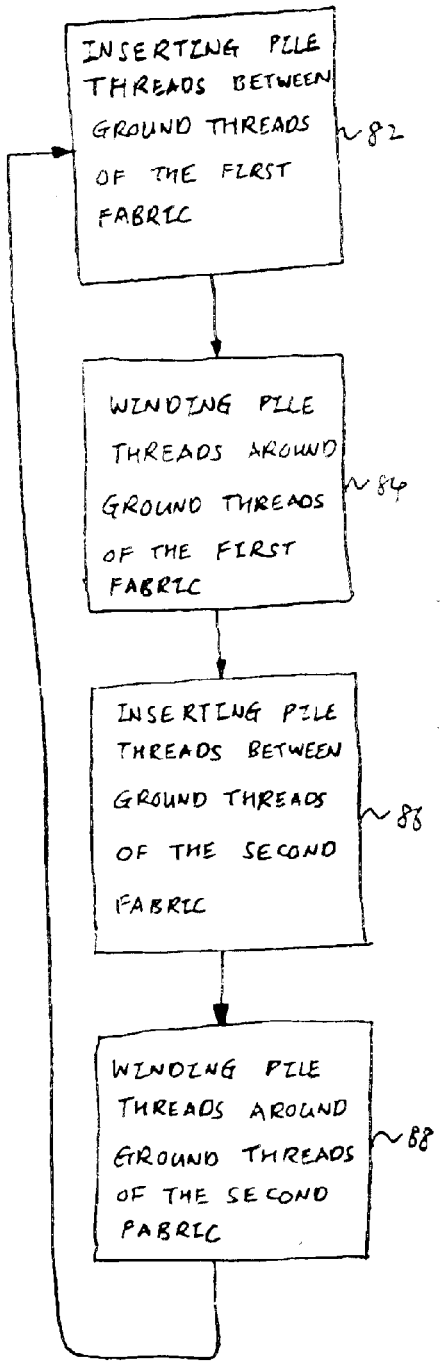
FIG. 15 is a flow diagram showing a weaving step of the method.

FIG. 15 shows that the weaving step 70 comprises detailed steps 82–88. In step 82, the free ends 32 of the plurality of the pile threads 34 are inserted between the ground threads 36 of the first fabric 28. In step 84, the pile threads 34 are wound around one of the ground threads 36 of the first fabric 28 by one or more turns. In step 86, the free ends 32 of the plurality of the pile threads 34 are inserted between the ground threads 36 of the second fabric 30. In step 88, the pile threads 34 are wound around one of the ground threads 36 of the second fabric 30 by one or more turns. The steps 82–88 are repeated until the first and second fabrics 28, 30 are weaved to a predetermined size.

Figure 12:
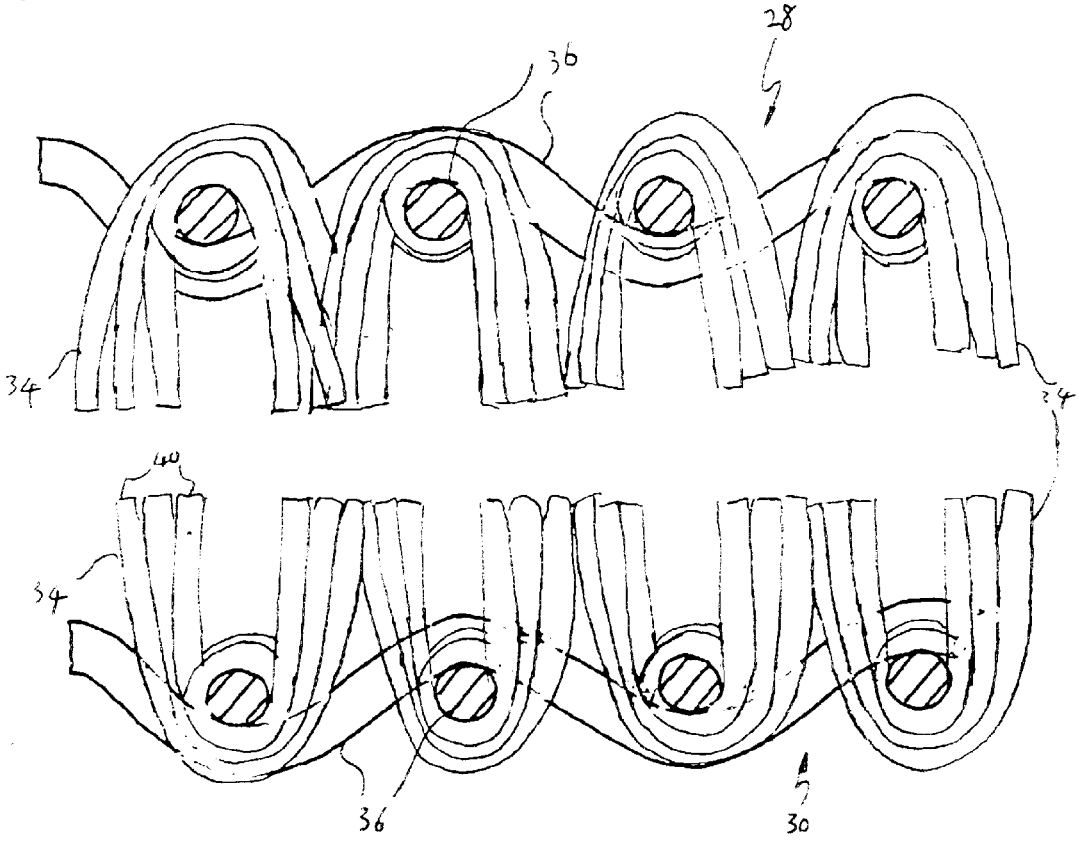
FIG. 12 is a schematic view showing that the pile threads are cut to separate the two fabrics.

Referring FIG. 14 again, the second step 72 of the method is cutting the pile threads 34 between the first and the second fabrics 28, 30. FIG. 11 shows that a cutter 38 is positioned half way between the first fabric 28 and the second fabric 30 so that the pile threads 34 between the two fabrics 28, 30 are cut by an equal length. FIG. 12 shows that the first fabric 28 and the second fabric 30 are separated after the cutting step 72, and cut ends 40 of the pile threads 34 have been formed by the cutting step 72.

Since the pile threads 34 are wound around the ground threads 36, and supported between the first fabric 28 and the second fabric 30, they are under tight tension as their weaved state before the cutting step 72. Also, the cutting is performed after the two fabrics 28, 30 are completely weaved. Thus, all of the pile threads 34 are cut just in one operation of the cutter 38. As a result, the cut ends 40 of the pile threads 34 have uniform surface height of a tolerance of ±0.5 mm (0.02 inch); variations of the height and density of the pile threads 34 along left or right direction of the fabrics 28, 30 are minimized; and the cut ends 40 have a fine cut state.

As the pile threads 34 are inserted more densely, that is as the weight percentage of the pile threads 34 increases, the spaces between the ground threads 36 become wider. Since the pile threads 34 are wound around the ground threads 36 by one or more turns, the possibility that the piles would fall out of the fabrics 28, 30 during the service life of a blanket is prevented.

Figure 13:
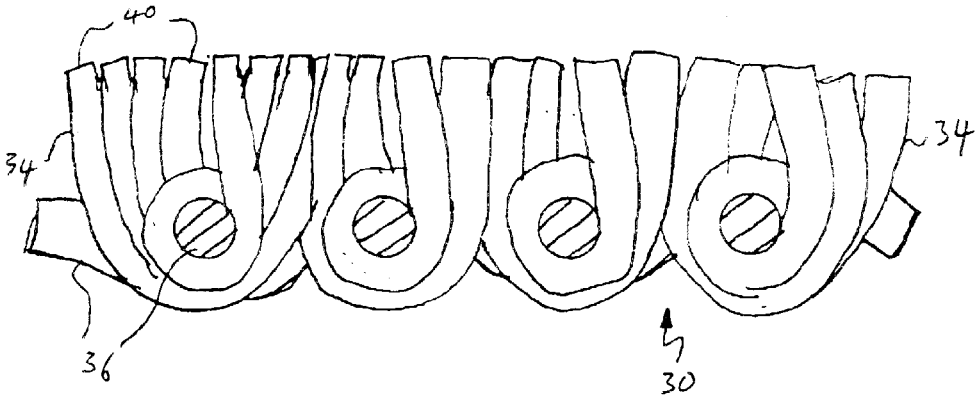
FIG. 13 is a schematic view showing that the pile threads became shorter in length, and larger in diameter after heat setting.

Referring FIG. 14 again, the third step 74 of the method is coloring the fabrics 28, 30 with a predetermined pattern to get desired decorating effect of the fabrics. The fourth step 76 of the method is heat setting the first and second fabrics 28, 30 to bind the pile threads to the ground firmly. When the fabrics 28, 30 are heated, the pile threads 34 and the ground threads 36 contract in length; expand in diameter; and become softer. FIG. 13 shows that the pile threads 34 became shorter and thicker, and the ground threads 36 became closer with one another after the heat setting step 76. The thickened pile threads 34 are distributed uniformly on the surface of the fabric 28, 30, and provide good appearance and feel to the fabrics 28, 30.

The heat setting step 76 is performed by immersing the entire fabric 28, 30 in hot water and then drying the fabric 28, 30. Alternatively, the heating step 76 may be performed by heating the fabric 28, 30 with ultrasonic wave or with microwave.

In addition, the pile threads 34 may be welded to the ground threads 36. Ultrasonic wave energy or microwave energy is concentrated to the portion where the pile threads 34 are wound around the ground threads 36 so that they partially melt and weld together. Other portions of the pile threads 34 and the ground yarns 36, do not melt since they receive substantially lower energy that the portion where the pile threads 34 are wound around the ground threads 36.

Referring FIG. 14 again, the fifth step 78 of the method is cutting the fabric 28, 30 to a predetermined size for a blanket. The sixth step 80 of the method is finishing in which edges of the cut fabric are surrounded with a cloth to hide and to protect the edges.

Table 1 below shows examples of compositions of fabrics for making blankets according to the present invention.

TABLE 1

| | | COMPOSITION | |
|---|---|---|---|
| 1 | PILE | 100% ACRYLIC SPUN YARN RAW WHITE 2/32 SMM, BRIGHT HIGH BULKY ON CONE | 83.5% |
| | GROUND | 65% POLYESTER (S/D) 35% CARDED COTTON BLENDED SPUN YARN 10'S/1 IN GREY ON CONE | 11.5% |
| | | 100% POLYESTER F.YARN 150D/48F (R/W) (S/D) | 5% |
| 2 | PILE | 100% ACRYLIC SPUN YARN R/W 2/32'S (BR) | 90% |
| | GROUND | 100% POLYESTER F/YARN 150D R/W S/D | 10% |
| 3 | PILE | 100% ACRYLIC SPUN YARN RAW WHITE 2/32 SMM, BRIGHT HIGH BULKY ON CONE | 80% |
| | GROUND | 65% POLYESTER (S/D) 35% CARDED COTTON BLENDED SPUN YARN 10'S/1 IN GREY ON CONE | 12% |
| | | 100% POLYESTER F.YARN 250D/48F (R/W) (S/D) | 8% |
| 4 | PILE | 32 SMM 100% ACRYLIC HIGH BULKY BRIGHT YARN RW ON CONE | 80% |
| | GROUND | POLYESTER 65% (S/D) COTTON 35% P.E.YARN 10'S/1 ECC RAW WHITE | 12% |
| | | 100% POLYESTER F.YARN 250D/48F (R/W) (S/D) | 8% |
| 5 | PILE | 100% ACRYLIC SPUN YARN R/W 2/32 BR HIGH BULKY | 89% |

TABLE 1-continued

| | | COMPOSITION | |
|---|---|---|---|
| | GROUND | POLYESTER F.YARN RAW WHITE 150D (S/D) | 5% |
| | | POLYESTER 65% (S.D) CARDED COTTON 35% BLENDED OPEN-END SPUN YARN NE 20'S/1 R/W ON CONE | 6% |
| 6 | PILE | 100% ACRYLIC SPUN YARN RAW WHITE 2/32 SMM BRIGHT HIGH BULKY ON CONE | 82% |
| | GROUND | POLYESTER (S/D) 70% CARDED COTTON 30% BLENDED SPUN YARN 10'S/1 IN GREY | 12% |
| | | 100% POLYESTER F.YARN 150D/48F (R/W) (S/D) | 6% |
| 7 | PILE | 100% ACRYLIC SPUN YARN R/W 2/32'S BR HIGH BULKY | 87% |
| | GROUND | POLYESTER F.YARN RAW WHITE +50D (SD) | 5% |
| | | POLYESTER 80% CARDED COTTON 20% BLENDED OPEN0END SPUN YARN NE 20'S/1 R/W ON CONE | 8% |

With the above methods, the present invention provides a high quality blankets having a superior and luxurious feel and appearance. The blankets are durable enough to keep the quality during the service life. The methods are easy to implement as part of the process of making blankets. The blankets have high pile density and the pile threads have finely finished ends.

Although the invention has been described in considerable detail, other versions are possible by converting the aforementioned construction. Therefore, the scope of the invention shall not be limited by the specification specified above.

What is claimed is:

1. A method for making a fabric, wherein the fabric has a ground having a plurality of ground threads, and a plurality of pile threads inserted between the ground threads, comprising the steps of:

a) weaving a first fabric and a second fabric simultaneously, wherein the first and second fabrics are positioned parallel with each other and spaced from each other by a predetermined distance, and the pile threads are inserted alternately between the ground threads of the first fabric and between the ground threads of the second fabric, and wherein each of the pile threads is wound around one of the ground threads by one or more turns;

b) cutting the pile threads between the first and the second fabrics; and c) heat setting each of the first and second fabrics to bind the pile threads to the ground firmly;

wherein the pile threads are made of acrylic yarn, and wherein the weight percentage of the pile threads in each of the fabrics is in the, range between approximately eighty-five (85) and ninety-five (95), and the weight percentage of the ground threads in each of the fabrics is the remainder.

2. The method of claim 1 wherein the weaving step comprises the steps of:

a) inserting free ends of the plurality of the pile threads between the ground threads of the first fabric;

b) winding the pile threads around one of the ground threads of the first fabric by one or more turns;

c) inserting the free ends of the pile threads between the ground threads of the second fabric;

d) winding the pile threads around one of the ground threads of the second fabric by one or more turns; and e) repeating steps a) through d) until the first and second fabrics are weaved to a predetermined size.

3. The method of claim 1 wherein the ground threads are made of polyester, cotton, or a blend of polyester and cotton.

4. The method of claim 1 wherein the heat setting step comprises heating each of the fabrics such that the ground threads and the pile threads contract in length and expand in diameter.

5. The method of claim 4 wherein the step of heating comprises the step of immersing the fabric in hot water and then drying the fabric.

6. The method of claim 4 wherein the step of heating comprises the step of heating the fabric with ultrasonic wave.

7. The method of claim 4 wherein the step of heating comprises the step of heating the fabric with microwave.

8. The method of claim 1 wherein the heat setting step comprises heating each of the fabrics such that the ground threads and the pile threads weld together.

9. The method of claim 8 wherein the step of heating comprises heating the fabric with ultrasonic wave.

10. The method of claim 8 wherein the step of heating comprises the step of heating the fabric with microwave.

11. The method of claim 1 further comprising a step of coloring the fabric with a predetermined pattern between the cutting step and the heat setting step.

12. A fabric made according to the method of claim 1.

13. A method of making a blanket from a fabric made according to the method of claim 1 comprising the steps of:

a) cutting the fabric to a predetermined size for the blanket; and b) surrounding the edges of the cut fabric with a cloth.

14. A blanket made according to the method of claim 13.

15. The method of claim 1 wherein the weight percentage of the pile threads in each of the fabrics is in the range between approximately eighty-seven (87) and ninety-five (95), and the weight percentage of the ground threads in each of the fabrics is the remainder.

16. The method of claim 15 wherein the weight percentage of the pile threads in each of the fabrics is in the range between approximately ninety (90) and ninety-five (95), and the weight percentage of the ground threads in each of the fabrics is the remainder.

* * * * *